United States Patent [19]

Kelly

[11] Patent Number: 4,613,176

[45] Date of Patent: Sep. 23, 1986

[54] DOOR LATCH MECHANISM

[75] Inventor: Michael A. Kelly, Felton, Pa.

[73] Assignee: Reliable Security Systems, Inc., Cockeysville, Md.

[21] Appl. No.: 508,874

[22] Filed: Jun. 29, 1983

[51] Int. Cl.[4] ..... E05C 3/00

[52] U.S. Cl. ..... 292/201; 70/92; 292/341.19; 292/DIG. 49; 292/DIG. 55; 292/DIG. 60; 292/DIG. 65

[58] Field of Search ..... 292/201, DIG. 55, DIG. 60, 292/341.18, DIG. 49, 341.19, 45, 52, 78, 79, 92, 93, 192, 209, DIG. 65; 70/448, 92

[56] References Cited

U.S. PATENT DOCUMENTS

| | | | |
|---|---|---|---|
| 1,062,084 | 5/1913 | Desbecker | 292/201 X |
| 1,493,105 | 5/1924 | Carroll | 70/448 |
| 2,231,414 | 2/1941 | Model | 292/341.18 |
| 2,622,431 | 12/1952 | Cerf, Jr. | 70/448 |
| 2,713,506 | 7/1955 | Wickstrom | 292/341.18 |
| 2,851,296 | 9/1958 | Guyaz | 292/78 |
| 3,751,088 | 8/1973 | Schlage et al. | 292/201 |
| 3,805,693 | 4/1974 | Neitzel et al. | 292/201 X |
| 3,971,239 | 7/1976 | Lavis | 70/448 X |
| 4,142,751 | 3/1979 | Varda | 292/DIG. 49 X |
| 4,470,625 | 9/1984 | Walsh et al. | 292/92 X |
| 4,540,208 | 9/1985 | Logan, Jr. et al. | 292/92 X |

FOREIGN PATENT DOCUMENTS

| | | | |
|---|---|---|---|
| 0065418 | 11/1982 | European Pat. Off. | 70/92 |
| 716086 | 12/1931 | France | 292/DIG. 55 |
| 304335 | 3/1955 | Switzerland | 292/201 |

*Primary Examiner*—Gary L. Smith
*Assistant Examiner*—Lloyd A. Gall
*Attorney, Agent, or Firm*—Leonard Bloom

[57] ABSTRACT

A door latch mechanism has a pivoted latch disposed between a retaining solenoid and a four-bar toggle linkage. The toggle linkage connects the operating stem of the solenoid to the latch, has an under-the-center arrangement in a direction away from the solenoid in the latched position of the mechanism, and provides a substantial mechanical advantage to amplify the holding force of the solenoid. When the solenoid is de-energized and pressure is applied to open the door, the latch pivots and the toggle linkage collapses to release the keeper bar. The keeper bar is trapped but has a limited movement in both horizontal and vertical directions in a plane substantially parallel to the pivot axis of the latch. The overall arrangement is relatively simple, compact, inexpensive, easy to install, and reliable in its operation.

1 Claim, 11 Drawing Figures

DOOR LATCH MECHANISM

FIELD OF THE INVENTION

The present invention relates to a door latch mechanism, and more particularly, to a solenoid-retained door latch mechanism employing a toggle linkage having a mechanical advantage.

BACKGROUND OF THE INVENTION

In the prior art relating broadly to closure release devices, a solenoid-retained (or actuated) mechanism employing a toggle linkage is well known.

For example, in the U.S. Pat. No. 3,207,273, to Jurin, opening of the door causes it to engage a roller carried by a switch arm pivotably mounted on a fixed pin, and the switch arm pivots to close a switch to energize a solenoid. When the solenoid is energized, its armature is retracted, thereby lifting a link pivotably connecting the armature to the junction of a pair of toggle levers. The other end of one of the toggle levers is pivoted on a fixed pin, while the respective other end of the other lever is pivotably connected to a support lever. This support lever carries a brace pivotably mounted on the fixed pivot pin for the switch arm. Because of the toggle linkage, the support lever rotates clockwise (in the orientation shown). A catch arm subassembly is carried on the end of the support lever and is lowered into position on the other side of the door. A roller on the lowermost end of the catch arm subassembly engages the other side of the door and cooperates with the roller on the switch arm to retain the door in its open position. When the solenoid is de-energized, the toggle linkage falls (by gravity) into its alternate position; the support lever rotates counterclockwise; and the catch arm subassembly is lifted sufficiently to clear its roller and allow the door to be closed.

In a co-pending application for U.S. patent, Ser. No. 263,955, entitled "Emergency Exit Door Latch With Hydraulic and Electric Delay", now U.S. Pat. No. 4,470,625 issued on Sept. 11, 1984 assigned to the assignee of the present invention, a toggle linkage is connected to a latch by means of a hydraulic cylinder, and the solenoid is disposed between the latch and the toggle linkage. The hydraulic cylinder is designed to provide a hydraulic-type of time delay, which provides a fail-safe back-up system for an electronically-activated time delay for de-energizing the solenoid.

Moreover, in commercially-available magnetic door latches, energization of a solenoid is intended to attract a spring-loaded cylindrical bolt made of a magnetic material, thereby maintaining the door in a latched or locked position. De-energization of the solenoid, as by insertion of a magnetically-coded card, will release the spring-loaded bolt for opening the door and gaining access therethrough. These magnetic door latches, which are widely used for security purposes in governmental, industrial and commercial facilities, are relatively expensive. Their installation requires a precision "male/female" alignment between the bolt and the solenoid. The tolerances are critical, thereby escalating the cost. Moreover, any settlement of the building structure over time may cause misalignments between the bolt and its solenoid, thereby causing the conventional magnetic door latch to jam or otherwise malfunction. As a result, service calls are relatively frequent, and security or access is temporarily interrupted.

While this problem with respect to conventional magnetic door latches has persisted for many years, no one to date has conceived or developed a commercially-practical solution involving the use of a solenoid-retained toggle linkage for the purposes intended.

SUMMARY OF THE INVENTION

Accordingly, it is an object of the present invention to provide a door latch mechanism, suitable as a replacement for the conventional magnetic door latches as well as for other purposes, wherein the mechanism is relatively simple, compact, inexpensive, easy to install, and reliable in its operation.

It is another object of the present invention to provide a door latch mechanism having a solenoid, toggle linkage, latch and keeper arrangement, wherein the component parts are readily available or producible for simplified inventory management, and wherein the overall assembly may be easily installed either in new applications or on a retrofit basis out in the field.

It is yet another object of the present invention to provide a door latch mechanism which employs a solenoid in conjunction with a four-bar toggle linkage pivotably connected between the solenoid and a latch, the linkage exerting a decided mechanical advantage to substantially amplify the holding force of the solenoid for retaining the mechanism in its latched position.

It is a further object of the present invention to provide, in conjunction with a pivoted latch and solenoid-retained toggle linkage, a "floating" keeper cooperating with the latch and having a limited movement in both horizontal and vertical directions in a given plane, thereby simplifying the installation of the mechanism and accommodating any future misalignment between the door and the frame, such as may occur due to settlement of the building structure.

It is a still further object of the present invention to provide an overall assembly of a door latch mechanism which is not restricted to a particular access opening, but rather will facilitate both a "right" handed and a "left" handed installation.

It is a yet still further object of the present invention to readily accommodate a "hard" mounting of the door latch mechanism for repeated and frequent opening and closing of the door in a relatively "punishing" environment, one in which the mechanism is required to operate smoothly and reliably over extended periods of time.

In accordance with the teachings of the present invention, a preferred embodiment of a door latch mechanism is disclosed herein, operative between a door and a frame, and including a housing means and a keeper means (one of which is mounted on the door and the other of which is mounted on the frame). A solenoid in the housing means includes an armature having a free end. An operating stem has one end pivotably connected to the free end of the armature. The toggle linkage includes first and second links having their respective one ends pivotably mounted to the other end of the operating stem. The other end of the first link is pivotably mounted to the housing. A third link has one end pivotably mounted to the housing. A rigid, unitary fourth link has one end pivotably connected to the other end of the second link and to the other end of the third link, respectively. A latch cooperates with the keeper means, and the latch is disposed between the armature and the first and second links and is further disposed substantially transversely of the operating stem. One portion of the latch is pivotably mounted to the housing, and a second portion of the latch is pivotably connected to the other end of the fourth link.

In accordance with the further teachings of the present invention, there is disclosed a compact solenoid-retained door latch mechanism operative between a door and a frame and having a latched and an unlatched position. The mechanism includes a housing means and a keeper means, one of which is mounted on the door and the other of which is mounted on the frame. The housing means includes a base, a lid and a channel-shaped cover overlying the base and lid and having a recess therein. The base and lid have cooperating first, second and third bosses formed therein, respectively. First, second and third pins are mounted in the respective bosses. A toggle linkage is disposed at the one end of the housing and includes first, second, third and fourth links, each of which links has one and other ends, respectively. Respective means are provided for pivotably mounting the one end of the first link on the second pin; for pivotably mounting the one end of the third link on the third pin; for pivotably connecting the other end of the first link to the one end of the second link; and for pivotably connecting the other end of the second link to the other end of the third link. A solenoid having a reciprocating armature is mounted on the base at the other end of the housing. Resilient means are provided for constantly urging the armature outwardly of the solenoid. A substantially C-shaped latch is disposed between the toggle linkage and the solenoid. This latch has a short leg, a long leg, and a cross member which confronts the armature of the solenoid. Respective additional means are provided for pivotably mounting the latch between the cross member and the longer leg thereof on the first pin; for pivotably connecting the one end of the fourth link to the other end of the second link and to the other end of the third link, respectively; and for pivotably connecting the other end of the fourth link to the latch between the cross member and the shorter leg thereof. A keeper means extends through the recess in the cover and cooperates with the shorter leg of the latch in the latched position of the mechanism. An operating stem has one end thereof pivotably connected to the armature and the other end thereof pivotably connected between the first and second links, respectively. This operating stem is disposed substantially transversely of the cross member of the latch, and the first and second links are in an under-the-center arrangement in a direction away from the solenoid. With this arrangement, the toggle linkage (which is in its under-the-center position) substantially amplifies the relatively-small retaining or holding force exerted by the solenoid on the mechanism. When the solenoid is de-energized and pressure is subsequently exerted on the door to move it away from the frame, the force on the mechanism exerted via the door (supplemented by the force of the resilient means) causes the toggle linkage to collapse and the latch to pivot about the first pin. The keeper means is thereby released from the latch; the mechanism moves from its latched to an unlatched position; and the door may be opened for access therethrough.

These and other objects of the present invention will become apparent from a reading of the following specification taken in conjunction with the enclosed drawings.

DESCRIPTION OF THE PREFERRED EMBODIMENT

Figure 1:
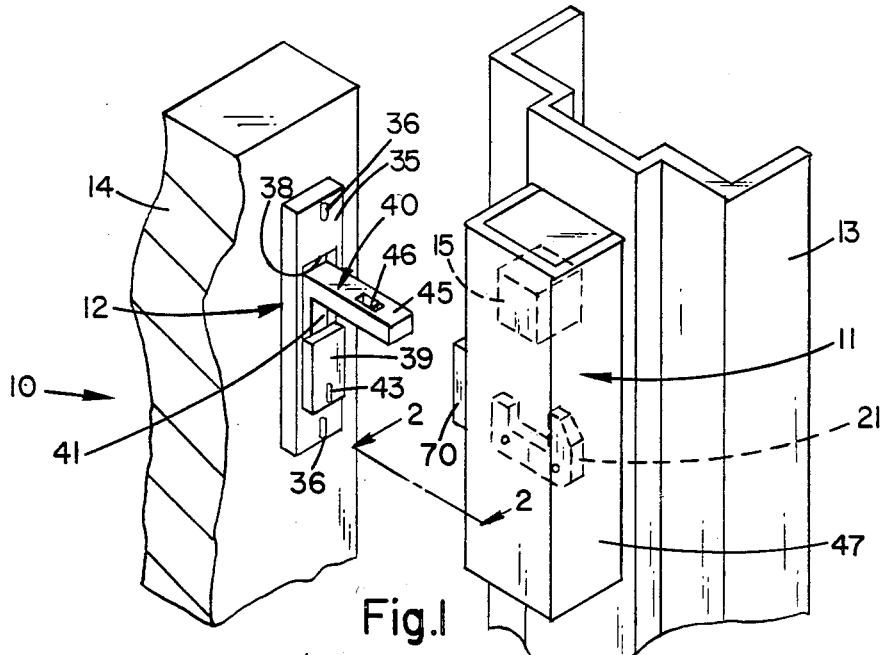
FIG. 1 is a partial perspective of the door latch mechanism mounted between the door and the frame in a typical installation.

With reference to FIG. 1, the door latch mechanism 10 of the present invention generally comprises a latch assembly 11 and a keeper assembly 12. Preferably, the latch assembly is mounted on a door frame 13 (or equivalent frame means) and the keeper assembly is mounted on a door 14 (or equivalent closure means). If desired, however, the latch assembly could be mounted on the door, and the keeper assembly mounted on the frame. Moreover, it will be appreciated that the door latch mechanism is equally suitable for right-hand or left-hand doors, and may be mounted either vertically (as shown) or horizontally at the convenience of the installer.

With this in mind, and with further reference to FIGS. 2–6, the door latch mechanism is retained by means of a solenoid 15 (or other motor means). This arrangement assures that the mechanism is "fail safe". However, if desired, the solenoid could be arranged to actuate and release (rather than retain) the latch mechanism, in which case the mechanism would be "fail secure". The solenoid has an armature 16 whose free end is provided with a slot 17, and an operating bar or stem 18 is pivotably connected within the slot by means of a cotter pin 18A (as shown more clearly in FIG. 4). A relatively-light coil spring 19 (or other resilient means) is piloted on the armature and is retained between the cotter pin and the armature. The other end of the operating stem is pivotably connected to a four-bar toggle linkage (denoted generally at 20).

A substantially C-shaped latch 21 is disposed between the solenoid and the toggle linkage. The latch includes a cross member 22, a longer leg 23, and a parallel shorter leg 24. The open portion of the C-shaped latch confronts the solenoid, and the operating stem is transverse to the cross member of the latch and positioned therebelow. The corner of the latch, between the cross member and longer leg thereof, is pivotably mounted on a first fixed pivot pin 25.

The toggle linkage 20 comprises a first link 26, a second link 27, a third link 28, and a fourth link 29, each of which links has one and other ends, respectively. Each of the links, and especially the fourth link 29, is a single rigid, unitary member as shown on the drawings. The one end of the first link 26 is pivotably mounted on a second fixed pivot pin 30, as shown more clearly in FIG. 5. The one end of the third link is pivotably mounted on a third fixed pivot pin 31, as shown more clearly in FIG. 6. The other end of the first link 26 is pivotably connected to the one end of the second link 27 by means of a pin 32 (shown in FIG. 5) which constitutes a first movable (or translatory) pivot. The other end of the second link 27 is pivotably connected to the other ends of the third link 28 and fourth link 29, respectively, by means of a pin 33 (shown in FIG. 6) which constitutes a second movable (or translatory) pivot. The one end of the fourth link 29 is pivotably connected to the corner of the C-shaped latch, between the cross member and shorter leg thereof, by means of a pin 34 (shown in FIG. 6) which constitutes a third movable (or translatory) pivot. The other end of the operating stem is pivotably connected at the first movable pivot comprising the junction between the first and second links.

Figure 2:
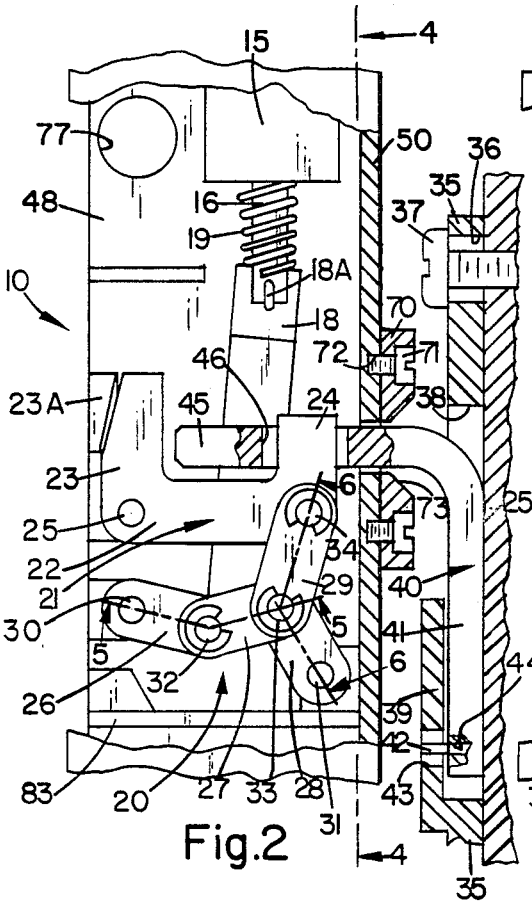
FIG. 2 is a plan view of the mechanism in its latched position, taken in the direction of the lines 2—2 of FIG. 1.
Figure 3:
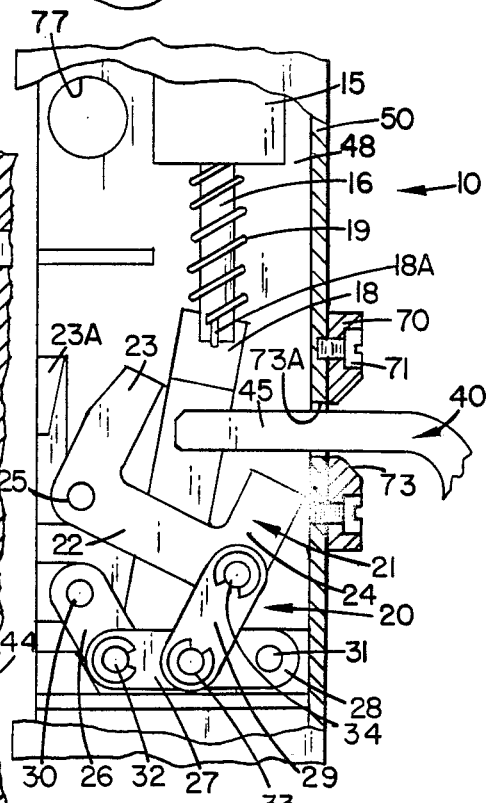
FIG. 3 is a plan view corresponding to FIG. 2, but showing the toggle linkage collapsed and the mechanism in its unlatched position.
Figure 4:
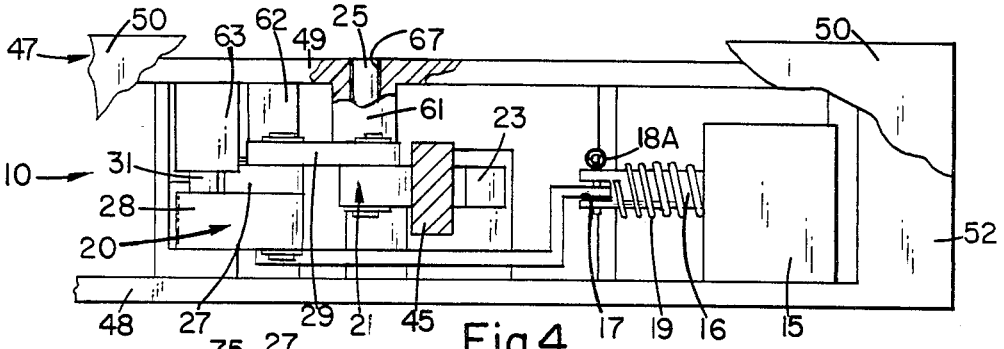
FIG. 4 is a side elevation of the mechanism taken along the lines 4—4 of FIG. 2.
Figure 5:
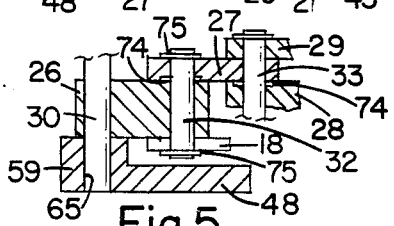
FIG. 5 is a detail section view of the pivoted first and second links of the toggle linkage, taken along the lines 5—5 of FIG. 2.
Figure 6:
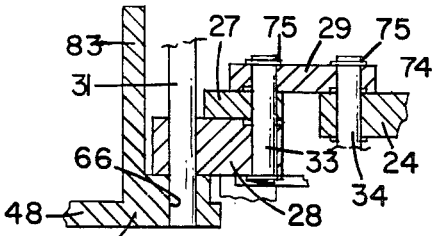
FIG. 6 is a detail section view of the third and fourth links of the toggle linkage, taken along the lines 6—6 of FIG. 2, and also showing a portion of the pivoted latch.
Figure 9:
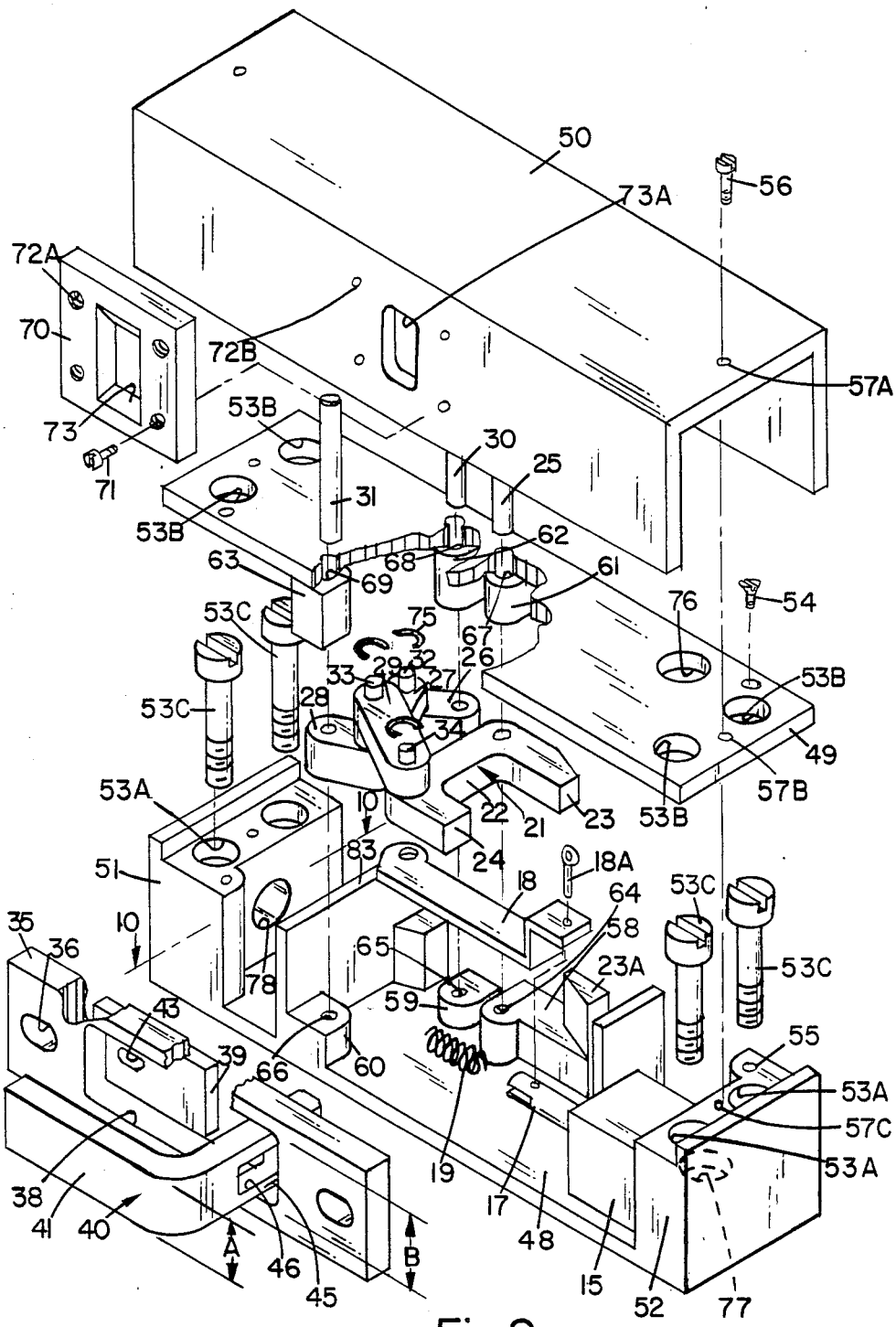
FIG. 9 is an exploded perspective of the complete door latch mechanism.

The keeper assembly 12 comprises a plate 35 having elongated slots 36 (one of which is shown in FIG. 2) for receiving mounting screws 37 for securing the plate to the door. This slotted arrangement facilitates locating or positioning of the keeper assembly with respect to the latch assembly mounted on the door. The plate has a central rectangular slot 38 and further has a projecting rectangularly-shaped boss 39 overlying the slot. A right-angularly bent keeper bar 40 has a vertical leg 41 trapped within the slot by means of the rectangular boss. A roll pin 42 is carried by the vertical leg of the keeper bar and is disposed in a slot 43 in the rectangular boss on the plate. The pin 42 is press-fitted within a hole 44 in the keeper. This arrangement allows the keeper bar to shift slightly (vertically in the orientation of the drawings) with respect to the plate of the keeper assembly. Moreover, the lateral width A of the vertical leg of the keeper bar is less than the lateral width B of the slot (as shown in FIG. 9) thereby allowing the keeper bar to shift slightly in a lateral or horizontal direction.

This overall arrangement allows the keeper bar to "float" slightly in both horizontal and vertical directions within the plane of the slot 38 and substantially parallel to the axis of the first fixed pivot 25, thereby accommodating tolerance accumulations, mounting variances, and relative sagging or misalignment developed between the door and frame during the extended life of the building structure. In the preferred embodiment, the amount of "float" of the keeper bar is in the order of 3/32 to $\frac{1}{8}$ of an inch. While accommodating a limited "floating" movement of the keeper bar in the plane of the slot in the plate, the keeper bar is trapped in place and is precluded from having a substantial movement in a plane perpendicular to the plane of the slot. Moreover, once the plate is installed, then even if the pin 42 were to be sheared off, the keeper bar cannot be removed from the slot in the plate. The keeper bar further has a horizontal leg 45 provided with an enlarged slotted recess 46 for receiving the shorter leg of the pivoted latch in the latched or locked position of the mechanism.

In operation, when the solenoid is de-energized, as by insertion of a specially-coded magnetic card (not shown herein), the holding force of the solenoid is removed. Subsequent pressure on the door to move it away from the frame exerts a force on the mechanism via the keeper engaging the latch (supplemented by the force of the relatively-light coil spring) which causes the toggle linkage to collapse and to pivot the latch about the first pin. The keeper bar is released from the latch; the door latch mechanism moves into its unlatched position as shown more clearly in FIG. 3; and the door may be opened for access to the enclosure.

Figure 7:
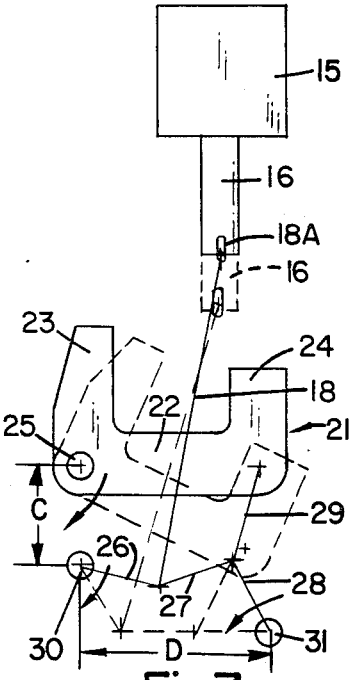
FIG. 7 is a schematic view of the toggle linkage, the armature of the solenoid, and an operating stem pivotably connected therebetween, the links and the latch pivoting in the direction of the arrows.

With reference to the schematic diagram of FIG. 7, the latched position of the mechanism is shown in solid lines and the unlatched position in broken lines. In the latched position of the mechanism, the toggle linkage (and more specifically, the first and second links 26,27) are in a slightly "under-the-center" position, that is, cocked away from the solenoid and in the direction of collapse of the toggle linkage. Collapse of the toggle linkage occurs when the solenoid is de-energized, its holding force is removed, and opening the door exerts a force (supplemented by the force of the spring) to pivot the latch to its unlatched position shown by the broken lines.

With further reference to FIG. 7, the first fixed pivot 25 and second fixed pivot 30 are disposed on one side of the mechanism (relatively close to each other) and the third fixed pivot is disposed on the other (or keeper) side of the mechanism. The toggle linkage is thus disposed substantially between the first and second fixed pivots (at one side) and the third fixed pivot at the other side. The distance between the first fixed pivot 25 and the second fixed pivot 30 (denoted by C) is substantially less than the distance between the second fixed pivot 30 and the third fixed pivot 31 (denoted by D). In this preferred embodiment, the first and second fixed pivots 25 and 30, respectfully, are substantially aligned with one another (vertically in the orientation shown) while the third fixed pivot 31 is disposed laterally (or horizontally) thereof and somewhat below the second fixed pivot 30.

In this embodiment, the toggle linkage exerts a decided mechanical advantage to substantially amplify the holding force exerted by the solenoid. The amount of this holding force of the solenoid need only be sufficient to retain the mechanism in its latched position; in the preferred embodiment, this holding force is approximately forty ounces. As a result, a relatively-small solenoid may be used, thereby contributing to the compactness, manufacturing economy, and operating efficiency of the mechanism.

Figure 8:
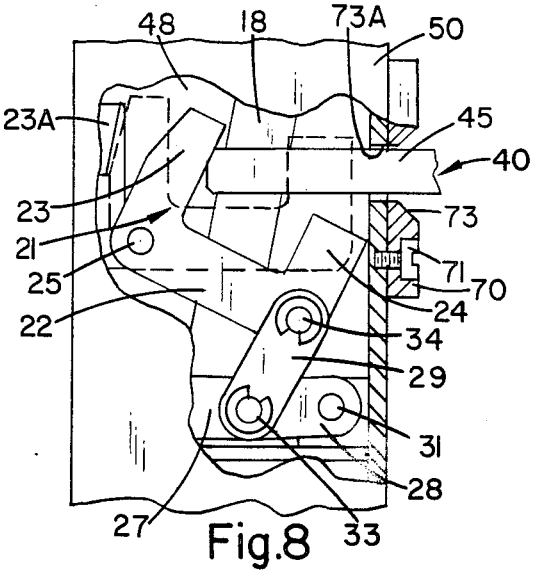
FIG. 8 is a partial plan view of the mechanism, corresponding to a portion of FIG. 3, but showing how the keeper engages the longer leg of the C-shaped latch to reset the mechanism back into its latched position.

With reference to FIG. 8, when the door is subsequently closed, the horizontal leg 45 of the keeper bar 40 engages the longer leg 23 of the C-shaped latch 21 and pivots the latch counterclockwise (as shown), thereby "resetting" the door latch mechanism and precluding a jamming or "freezing" of the toggle linkage. A stop member 23A is formed integrally with (the base of) the housing and takes up the slack to accommodate adverse forces that may occur when the door is slammed. By the same token, the armature will thus not be retracted too far within the solenoid.

With reference again to FIGS. 1–8, and with further reference to FIG. 9, the latch assembly 11 has a housing 47 including a base portion 48, a lid 49 and a substantially channel-shaped cover 50 overlying the lid and base. The base has upstanding rectangular bosses 51 and 52 at the respective ends thereof. Each of these bosses has holes 53A which aligned with corresponding holes 53B in the lid for receiving screws 53C for mounting the assembly to the frame. The lid is positioned on the top notched portions of the rectangular bosses and is secured thereto by screws 54 received in respective tapped holes 55 in the base. The securing of the lid to the base provides additional rigidity and results in an open-sided frame for the mechanism. The cover is positioned over the base and lid, and is secured thereto by screws 56 received through holes 57A in the cover, 57B in the lid, and tapped holes 57C in the base.

The intermediate portion of the base has first, second and third upstanding bosses 58,59 and 60, respectively, which, when the lid is secured to the base, match with corresponding first, second and third depending bosses 61,62 and 63 formed integrally with the lid. These pairs of corresponding bosses 58,61; 59,62; and 60,63; respectively, accommodate the first, second and third fixed pivot pins 25, 30 and 31, respectively. Each of the pivot pins is preferably press-fitted with a slight interference fit within holes 64, 65 and 66 formed within the upstanding lower bosses 58, 59 and 60, respectively, in the base. The upper portions of the pivot pins are slidably located or positioned within holes 67, 68 and 69 formed within the depending upper bosses 61,62 and 63 formed in the lid. The clearance between the three fixed pivot pins 25,30 and 31, respectively, and the holes in the depending bosses on the lid (which clearance has been somewhat exaggerated with respect to pin 25 in FIG. 4 for ease of illustration) is sufficient to accommodate tolerance accommodations in the overall assembly of the mechanism, yet provides a sufficient support for the free upper portions of the pressed-in pins in the respective bosses in the base.

The shock loads occasioned by frequent and repeated opening and closing of the door are taken up by these three fixed pivot pins 25, 30 and 31, respectively, and especially the third fixed pivot pin 31. The door latch mechanism of the present invention is "hard" mounted, as distinguished from the "soft" mounting inherent in the aforesaid co-pending application, wherein the intervening hydraulic cylinder in effect functions as a shock absorber to prevent slamming of the door. Nevertheless, the door latch mechanism of the present invention functions efficiently and reliably in this relatively "punishing" environment, yet is much less expensive and easier to install than the conventional magnetic door latches currently in widespread commercial usage and for which the mechanism herein is primarily intended to replace.

With reference again to FIGS. 2 and 9, a rectangular receptacle 70 is secured to the channel-shaped cover by screws 71 passing through holes 72A in the receptacle and received in tapped holes 72B in the cover. The receptacle is preferably molded from a suitable material, such as "Delrin", or nylon, or is otherwise made from a suitable material having an anti-friction quality. The receptacle has an opening 73 with tapered sides (shown in FIGS. 2 and 9) for guiding the keeper bar into its cooperation with the latch. The keeper bar extends through an opening 73A in the cover which is aligned with the opening in the receptacle.

With reference again to FIG. 4, the operating stem is preferably bent and is disposed below the pivoted latch, thereby reducing the height of the mechanism and contributing to its overall compactness.

With reference again to FIGS. 5 and 6, washers 74 are disposed between the toggle links and the other moving parts. Preferably, the washers are molded from nylon or another suitable material. The pivot pins for the movable (translatory) pivots are retained, vertically, by means of snap rings 75 received within respective complementary external annular grooves formed near the ends of the pivot pins. Moreover, if desired, all of the moving parts may be coated or sprayed with a lubricating-type of material, such as "Teflon", to reduce operating friction within the door latch mechanism. The base may be a unitary piece which is die-cast from aluminum or zinc, if desired. The latch and toggles may be formed from aluminum, preferably, but other materials are also feasible. The cover may be extruded or made by known metal-forming techniques.

With reference again for FIG. 9, holes 76 and 77 are formed in the lid and base, respectively. These holes provide access for wires (not shown) running to the solenoid. When the base is secured against the frame, hole 76 provides access for the solenoid wires; and when the latch assembly is reversed (for certain installations) and the lid is against the frame, then hole 77 in the base provides the required access. The installation of the latch assembly is relatively easy, requiring only connection of the solenoid wires and driving the four screws 53C.

Figure 10:
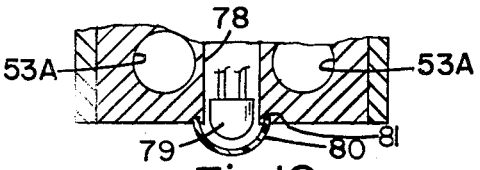
FIG. 10 is a section view taken along the lines 10—10 of a portion of FIG. 9, showing the use of a light-emitting diode for indicating that power is supplied to the solenoid.

With reference to FIG. 10, the rectangular boss 51 in the base 48 has a central hole 78. A light-emitting diode ("L.E.D.") 79 or its equivalent is housed in the hole and is connected in parallel with the solenoid by connecting wires or suitable means, which, being conventional, have been omitted for ease of illustration. A plastic lens cover 80 may be retained in a trepanned groove 81. The L.E.D. thus indicates that power is being supplied to the solenoid. The latch assembly will usually be mounted on the upper portion of the frame (right or left-handed) with the rectangular boss having the L.E.D. at the bottom, thereby providing a readily-visible indicator. This is a further improvement on the commercially-available magnetic door latches, wherein a special accessory package must be ordered and installed to provide an indicator light. As a result, a further savings is realized by means of the door latch mechanism of the present invention.

Figure 11:
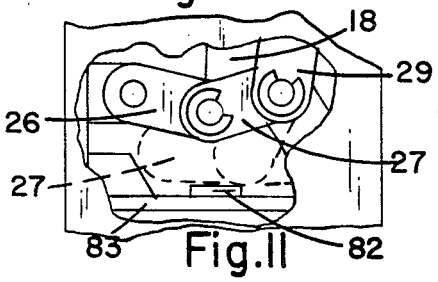
FIG. 11 corresponds to a portion of FIG. 3, showing the optional use of a permanent magnet to cooperate with a magnetizable one of the links to retain the toggle linkage in its unlatched position.

With reference to FIG. 11, the second link 27 may be made of steel or a suitable magnetizable material, and a small "button" type of permanent magnet 82 may be secured by an adhesive or other suitable means to the inside surface of upstanding wall 83 formed integrally with the base 48. The magnet will serve to temporarily retain the mechanism in its unlatched position, prior to the closing of the door and the engagement between the keeper bar and the longer leg of the pivoted latch to return the mechanism to its latched position as hereinbefore described.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A compact solenoid-retained door latch mechanism operative between a door and a frame and having a latched and an unlatched position, said mechanism comprising a housing means and a keeper means, one of said means being mounted on the door and the other of said means being mounted on the frame, the housing means including a base, a lid and a channel-shaped cover overlying the base and lid and having a recess therein, the base and lid having cooperating first, second and third bosses therein, respectively, first, second and third pivot pins mounted in said bosses, respectively, a four-bar pivoted toggle linkage at one end of the housing and including only first, second, third and fourth links, respectively, each of which links has one and other ends, respectively, each of the links comprising a single rigid unitary member, means pivotably mounting the one end of the first link on the second pin, means pivotably mounting the one end of the third link on the third pin, means pivotably connecting the other end of the first link to the one end of the second link, means pivotably connecting the other end of the second link to the other end of the third link, a solenoid mounted on the base at the other end of the housing, the solenoid having an armature, resilient means constantly urging the armature outwardly of the solenoid, a substantially C-shaped latch disposed between the toggle linkage and the solenoid, the latch having a cross member, a short leg and a parallel long leg, means pivotably mounting the latch between the cross member and the longer leg thereof on the first pin, means pivotably connecting the other end of the fourth link to the other end of the second link and to the other end of the third link, respectively, means pivotably connecting the one end of the fourth link to the latch between the cross member and the shorter leg thereof, wherein the ends of the fourth link have respective pivot axes, and wherein the fourth link comprises a substantially flat member pivoting in a plane transverse to said pivot axes, keeper means extending through the recess in the cover and cooperating with the shorter leg of the latch in a latched position of the mechanism, an operating stem having one end thereof pivotably mounted on the armature and the other end thereof pivotably connected between the first and second links, respectively, the operating stem being disposed substantially transversely of the cross member of the latch, wherein the first and second links are in an under-the-center arrangement in a direction away from the solenoid, whereby the solenoid exerts a relatively-small holding force on the mechanism, whereby the toggle linkage amplifies the holding force of the solenoid, and whereby when the solenoid is de-energized and pressure is subsequently exerted on the door to move it away from the frame, the force on the mechanism exerted via the door and supplemented by the resilient means, causes the toggle linkage to collapse and the latch to pivot about the first pin, whereby the keeper means is thereby released from the latch, the mechanism moves from its latched to an unlatched position, and the door may be opened for access thereto, wherein the housing means is mounted on the frame, and the keeper means is mounted on the door, wherein the keeper means comprises a right-angularly bent keeper bar having a pair of legs, one of the legs having a recess formed therein for receiving the shorter leg of the latch in the latched position of the mechanism, receptacle means carried by the cover for guiding the said one leg of the keeper bar into engagement with the latch, said receptacle means comprising a receptacle member having a substantially rectangular opening formed therein, said opening being provided with tapered sides, and means for trapping the other leg of the keeper bar on the door, and wherein the means for trapping the other leg of the keeper bar on the door comprises a plate having a central slot formed therein, a boss formed integrally with the plate and overlying a portion of the slot, whereby the other leg of the keeper bar is trapped in the slot between the boss and the door, and means for allowing the said other leg to shift slightly in both horizontal and vertical directions in the plane of the slot continuously during the operation of said door latch mechanism.

* * * * *